US006079994A

United States Patent [19]

Phillips

[11] Patent Number: 6,079,994

[45] Date of Patent: Jun. 27, 2000

[54] SWITCHING CONNECTOR

[75] Inventor: Michael John Phillips, Camp Hill, Pa.

[73] Assignee: The Whitaker Corporation, Wilmington, Del.

[21] Appl. No.: 09/015,991

[22] Filed: Jan. 30, 1998

[51] Int. Cl.[7] ..... H01R 29/00

[52] U.S. Cl. ..... 439/188; 439/879

[58] Field of Search ..... 439/188, 63, 581, 439/877, 879, 891, 675, 610, 944; 200/51.1

[56] References Cited

U.S. PATENT DOCUMENTS

| | | | |
|---|---|---|---|
| 1,526,102 | 2/1925 | Taft . | |
| 3,166,649 | 1/1965 | Frantz et al. | 200/51.1 |
| 3,976,580 | 8/1976 | Faber et al. | 200/51.1 |
| 4,025,145 | 5/1977 | Shaffer et al. | 439/610 |
| 4,408,824 | 10/1983 | Weidler | 339/258 |
| 4,633,048 | 12/1986 | Komatsu | 200/51.1 |
| 4,804,339 | 2/1989 | Cohen | 439/588 |
| 5,011,415 | 4/1991 | Suzuki et al. | 439/581 |
| 5,030,122 | 7/1991 | Birch et al. | 439/188 |
| 5,073,123 | 12/1991 | Birch et al. | 439/944 |
| 5,076,797 | 12/1991 | Moulton | 439/188 |
| 5,108,300 | 4/1992 | Weber | 439/188 |
| 5,267,871 | 1/1993 | Flanagan | 439/188 |
| 5,320,546 | 6/1994 | Weber | 439/188 |
| 5,429,529 | 7/1995 | Hashizawa et al. | 439/610 |
| 5,453,019 | 9/1995 | Garver et al. | 439/188 |
| 5,692,916 | 12/1997 | Halasz | 439/188 |
| 5,693,924 | 2/1997 | Fetterolf, Sr. et al. | 200/51.1 |
| 5,803,757 | 9/1998 | Wang | 439/188 |

OTHER PUBLICATIONS

PCT International Application with drawings, PCT/NL94/00300, Jun. 1995, International Search Report.

*Primary Examiner*—Renee Luebke
*Assistant Examiner*—T. C. Patel

[57] ABSTRACT

A switching coaxial electrical connection arrangement (10) including a plug (60) and a receptacle (20). The plug (60) has an outer shell (68), a dielectric (70) disposed inside the shell (68) and a center contact (72). The center contact (72) has a pin (104) extending from the dielectric (70) toward a mating end (64). The pin (104) is located along an axis which is separate from the central axis of the plug (60). Upon mating with the receptacle (20), the pin (104) engages a movable contact (38) at a point which is off center to urge the movable contact (38) away from a fixed contact (36). Because the movable contact (38) is engaged and urged at a point which is off center, it both translates and rotates away from the fixed contact (36).

3 Claims, 4 Drawing Sheets

SWITCHING CONNECTOR

FIELD OF THE INVENTION

This invention is related to electrical connectors and more particularly to a switching contact arrangement for such connectors.

BACKGROUND

With the increasing use of portable communication devices such as cellular telephones, comes an ever increasing need to reduce the size of these devices. Portable communication devices typically consist of a singular printed circuit board having communications components as well as electrical connectors mounted on the circuit board. The electrical connectors serve several purposes. For example, an electrical connector may be used to connect external power to the circuit board. An external antenna may also be connected to the circuit board via an electrical connector. Some of these electrical connectors also take a hybrid form. The hybrid type of connectors are typically used to connect both power and signal lines to the printed circuit board from the outside. One such electrical connector is taught by Fetterolf Sr. et. al. in U.S. Pat. No. 5,693,924. That patent teaches a switching contact mechanism for use in such a portable communication device.

In order to connect an external antenna to such portable communications devices, it is often necessary to utilize a coaxial switching electrical connector so that the internal antenna can be switched out when the external antenna is connected. An electrical connector suitable for this application is taught in U.S. Pat. No. 5,693,924. That patent teaches an electrical connector including a dielectric housing having mounted therein a pair of spaced apart cantilevered switch contacts. One of the switch contacts includes a contact arm extending toward the other contact in order to affect a wiping action upon mating and unmating with the mating connector.

Another switching coaxial electrical connector is disclosed in U.S. Pat. No. 5,108,300. That patent shows an electrical connector having a pair of switch contacts wherein the first switch contact is resiliently biased in engagement against a second switch contact which is fixed. As shown in FIG. 4, the first switch contact extends beyond the second fixed switch contact. Therefore, a mating contact would engage the first switch contact and urge it away from the second fixed switch contact thus opening the switch.

A problem exists in that it is desirable to minimize the space occupied by such a switching connector, while maintaining the electrical performance characteristics necessary for such a switch. Since these connectors are typically used to pass RF signals to and from either an internal or external antenna, it is desirable to not have capacitive coupling between the switch contacts when the switch is in an open state. Typically, this problem is addressed by ensuring that the switch contacts are at a specified distance away from each other when open. In order to achieve such separation, it may be necessary to increase the size of the connector. One approach is to make both contacts movable therefore allowing each contact to move only half the required distance in order to achieve the specified separation. Since each contact is only required to move a short distance, the beam length of each contact can be reduced while maintaining an acceptable contact force between the beams. Although this reduces the size of the connector, this arrangement is disadvantages in that because both contacts move the switch contacts may not return to their original position when the switch closes. This may result in stubbing upon mating with a plug. In order to alleviate the stubbing problem, it is desirable to fix one of the switch contacts to assure the position of each contact when the switch is closed. However when fixing one contact, the movable contact will be required to travel twice the distance. This results in the requirement for a longer beam length in order to achieve the required separation and contact force. Since the contact beam length which is longer in order to have the beam exhibit the necessary spring the connector size is increased. It is therefore desirable to achieve a fixed beam switching arrangement which allows for a minimum size connector while minimizing the capacitive coupling between switch contact as is necessary for an external an antenna arrangement.

SUMMARY

It is therefore an object of the invention to provide a coaxial electrical connector capable of switching while minimizing the switch contact separation and maintaining a low level of capacitive coupling between the switch contacts when in an opened state.

This and other objects have been achieved by providing a switching arrangement wherein one contact is fixed and a movable contact is positioned to be engaged by a mating contact at a point which is off center from an axis which extends along the beam of the movable contact. Engagement by the mating contact causes the movable contact to both translate and rotate away from the fixed contact upon mating.

BRIEF DESCRIPTION OF THE DRAWINGS

The invention will now be described by way of example with reference to the accompanying drawings of which.

DETAILED DESCRIPTION OF THE EMBODIMENT

Figure 1:
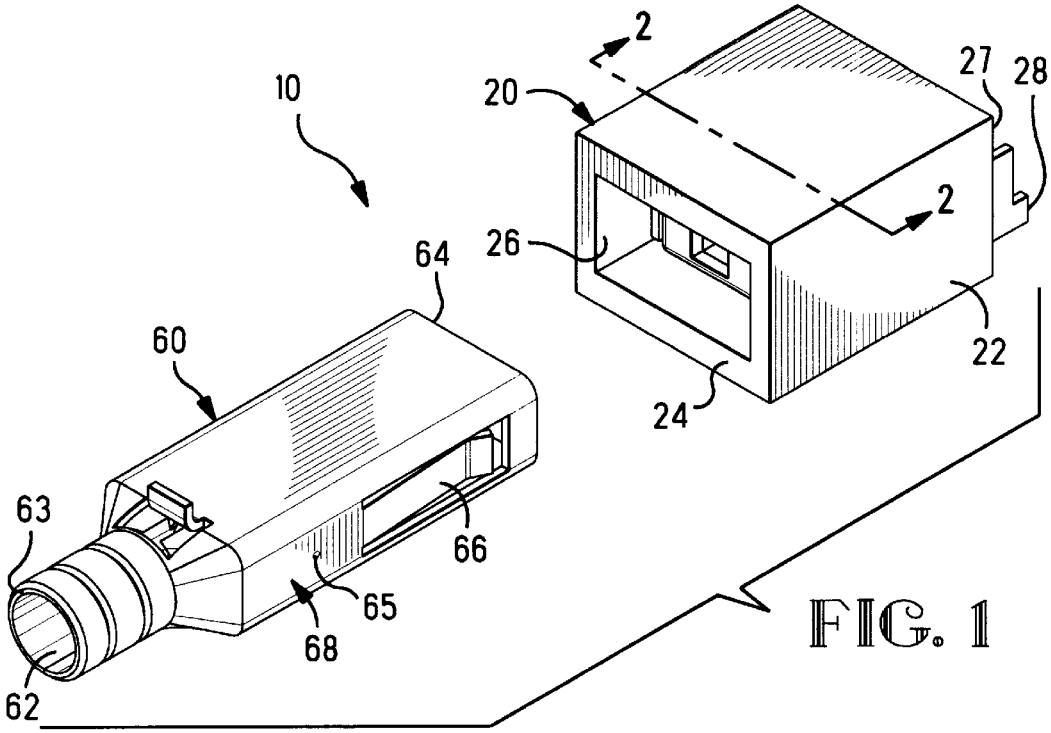
FIG. 1 shows a three dimensional view of a connector arrangement according to the present invention.

The connection arrangement of the present invention will first be described with reference to FIG. 1. The connection arrangement 10 consists of a receptacle 20 and a plug 60. The receptacle 20 features an insulative housing 22 having a mating end 24 and a plurality of surface mount contact feet 28 exiting the insulative housing 22 at a rear end 27. A plug receiving opening 26 is disposed at the mating end 24.

The plug 60 is formed of a conductive shell 68 having a mating end 64 and a cable receiving opening 62 disposed at a termination end 63. A pair of ground contact arms 66 are formed on opposing sides of the shell 68.

Figure 2:
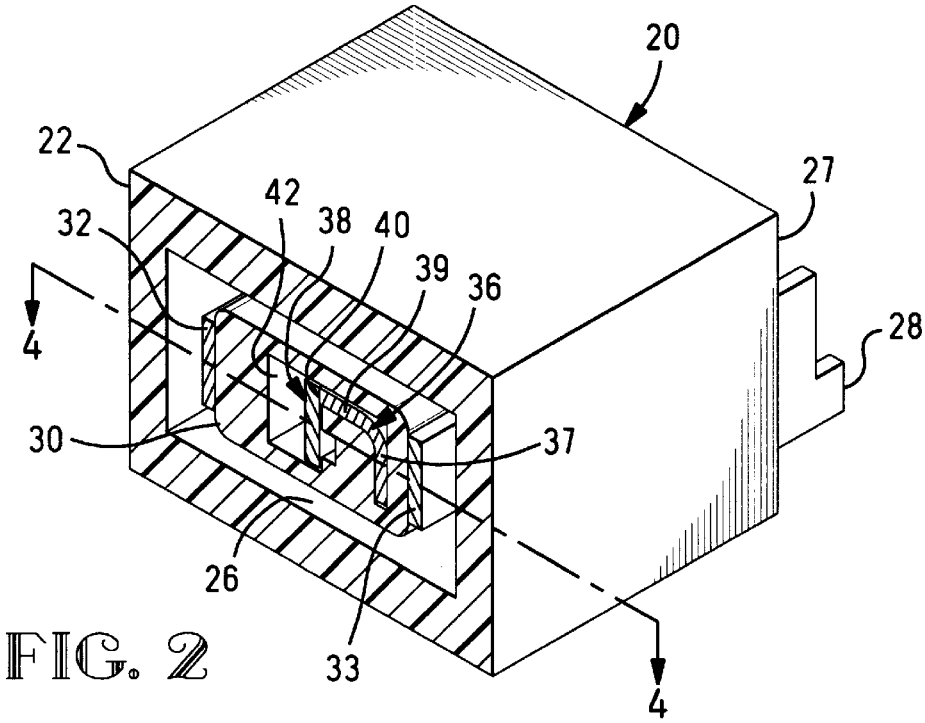
FIG. 2 shows a three dimensional sectional view of the receptacle shown in FIG. 1 taken along the line 2—2.
Figure 4:
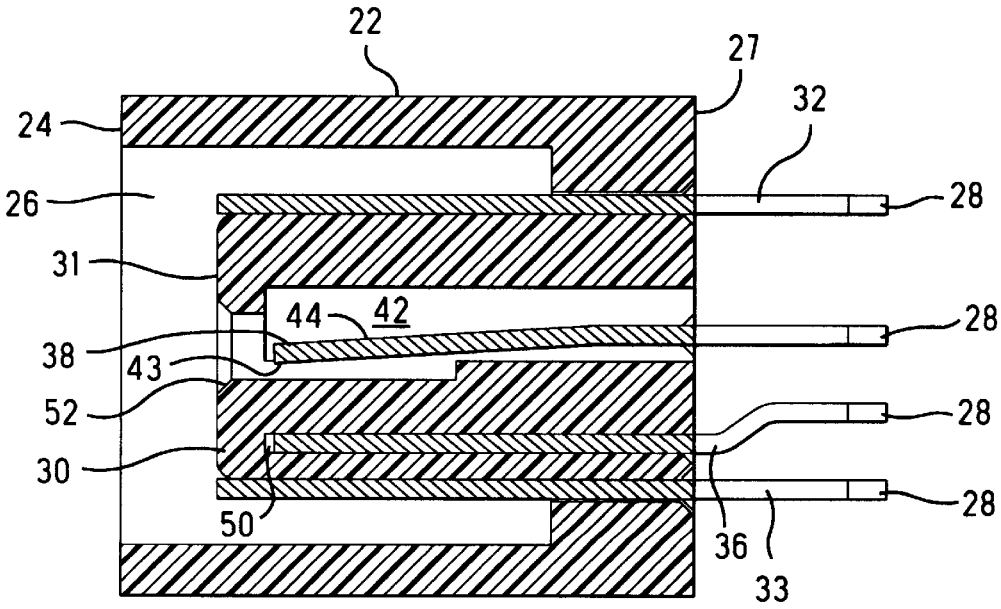
FIG. 4 shows a cross sectional view of the receptacle taken along the line 4—4 of FIG. 2.

The receptacle 20 will now be described in greater detail with reference to FIG. 2. The receptacle 20 consists of an insulative housing 22 having a plug receiving opening 26 extending inward from a mating end 24. The plug receiving opening 26 extends partially into the insulative housing 22 toward the rear end 27. A dielectric portion 30 extends from the rear end 27 into the plug receiving opening 26 toward the mating end 24. A pair of ground contacts 32, 33 are disposed on opposite ends of the dielectric portion 30, and extend from the rear end 27 along the dielectric portion 30. A fixed contact cavity 50 extends from the rear end 27 toward the mating end 24 (FIG. 4). The dielectric portion 30 has a plug receiving end face 31 having a pin receiving opening 52 formed therein. A switch passage 42 extends from the pin receiving opening 52 toward the rear end 27. A fixed contact 36 also extends from the rear end 27 toward the mating end 24. The fixed contact 36 is generally L-shaped and is secured inside the dielectric portion 30 as best shown in FIG. 2. The fixed contact 36 consists of a fixing leg 37 and an extending leg 39 which are disposed generally perpendicular to each other. A switch point 40 is located at the end of the extending leg 39. As shown in FIG. 4, the fixed contact 36 has a surface mount foot 28 extending from the rear end 27 of the insulative housing 22.

Figure 3:
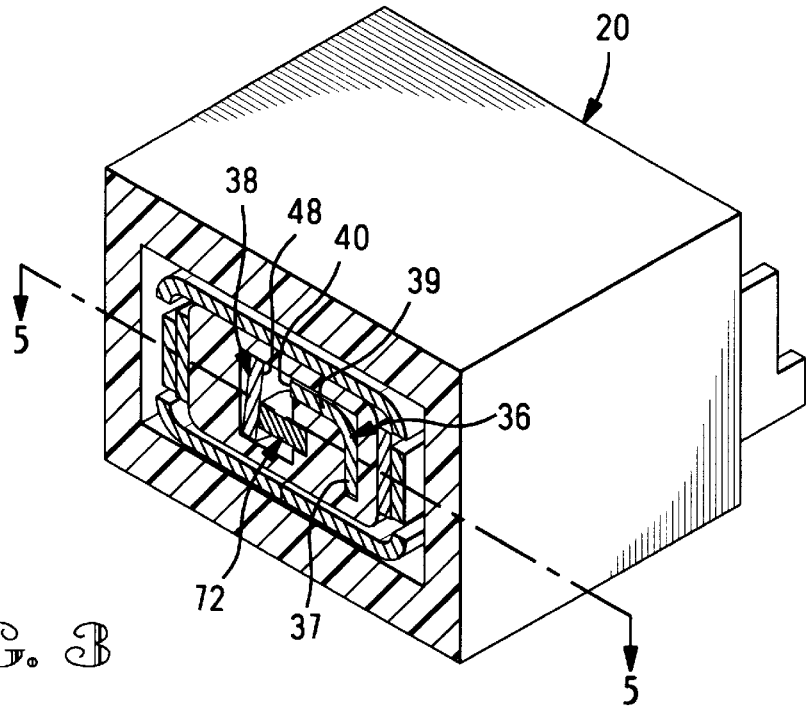
FIG. 3 shows a three dimensional sectional view similar to that of FIG. 2 wherein the switch mechanism is in an open condition.

A movable contact 38 is positioned inside a switch passage 42 which extends along the inside of the dielectric portion 30. The switch passage 42 is dimensioned to accommodate movement of the movable contact 38 which will be described below. As best shown in FIG. 4, the movable contact 38 consists of a surface mount foot 28 extending from the rear end 27 of the insulative housing 22 and a cantilever beam 44 extending from the rear end 27 toward the mating end 24. A switch point 48 is disposed at the top of the cantilever beam 44 along its free end 43. This switch point 48 is best seen in FIGS. 3 and 4.

Figure 7:
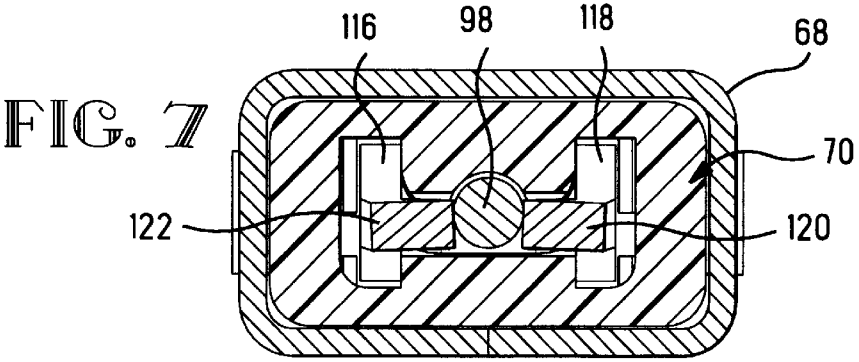
FIG. 7 shows a cross sectional view of the plug of FIG. 5 taken along the line 7—7.
Figure 6:
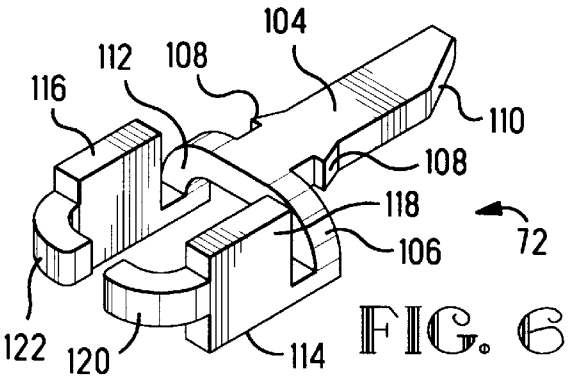
FIG. 6 shows a three dimensional view of a center contact used in the plug of FIG. 1.
Figure 8:
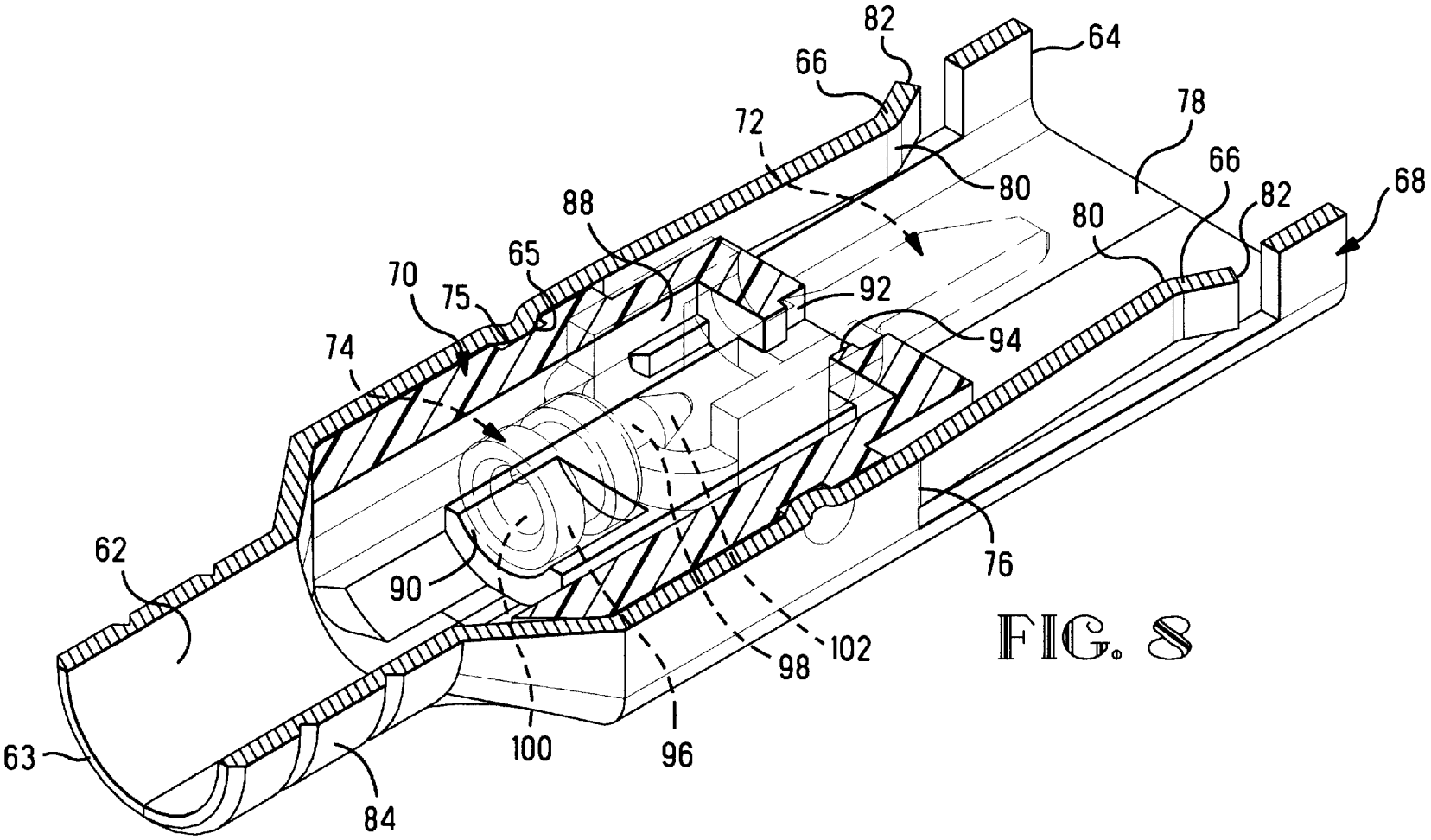
FIG. 8 shows a cross sectional view of the plug taken along the line 8-shaped of figure.

The plug 60 will now be described in greater detail with reference to FIGS. 5–8. The plug 60 consists of four major components. As best seen in FIG. 8, a shell 68 houses a dielectric 70, a center contact 72, and a wire receiving ferrule 74. The shell 68 has a pair of ground contact arms 66 formed along opposite ends thereof. The ground contact arms 66 extend from a bend 76 into a dielectric portion receiving area 78 where a contact point 80 is formed near a free end 82. A pair of dimples 65 are inwardly formed adjacent the ground contact arms 66. A crimp section 84 is formed in a cylindrical shape at the cable receiving end 63. A cable receiving passage 62 is formed inside the crimp section 84.

The dielectric 70 is shaped to have a cavity 88 inside. The cavity 88 has a semicylindrical support 90 for receiving the ferrule 74. A generally rectangular section extends from the semicylindrical support 90 to receive the center contact 72. An opening 92 is formed toward the mating end 64. Locking ledges 94 extend into the opening 92. A pair of notches 75 are formed along opposite outer sides of the dielectric 70 for cooperating with the dimples 65 of the shell 60

Ferrule 74 consists of a crimp section 96 and a contact section 98. The crimp section 96 forms a cylinder for receiving a wire into the opening 100 extending partially through the ferrule 74 from one end. The contact section 98 is continuous with the crimp section 96 and has a lead in surface 102.

The center contact 72 is shown positioned in the dielectric 70 in FIG. 8. It will now be described in greater detail with reference to FIG. 6. A rectangular pin section 104 extends from a main body 106. A pair of locking lances 108 are formed on opposite sides of the rectangular pin 104. A lead in surface 110 is provided near the free end of the rectangular pin 104. The main body 106 consists of an arcuate section 112, a base 114 formed of two end sections 116 and 118. A pair of arcuate contact arms 120 extend each from respective base sections 116, 118.

Figure 5:
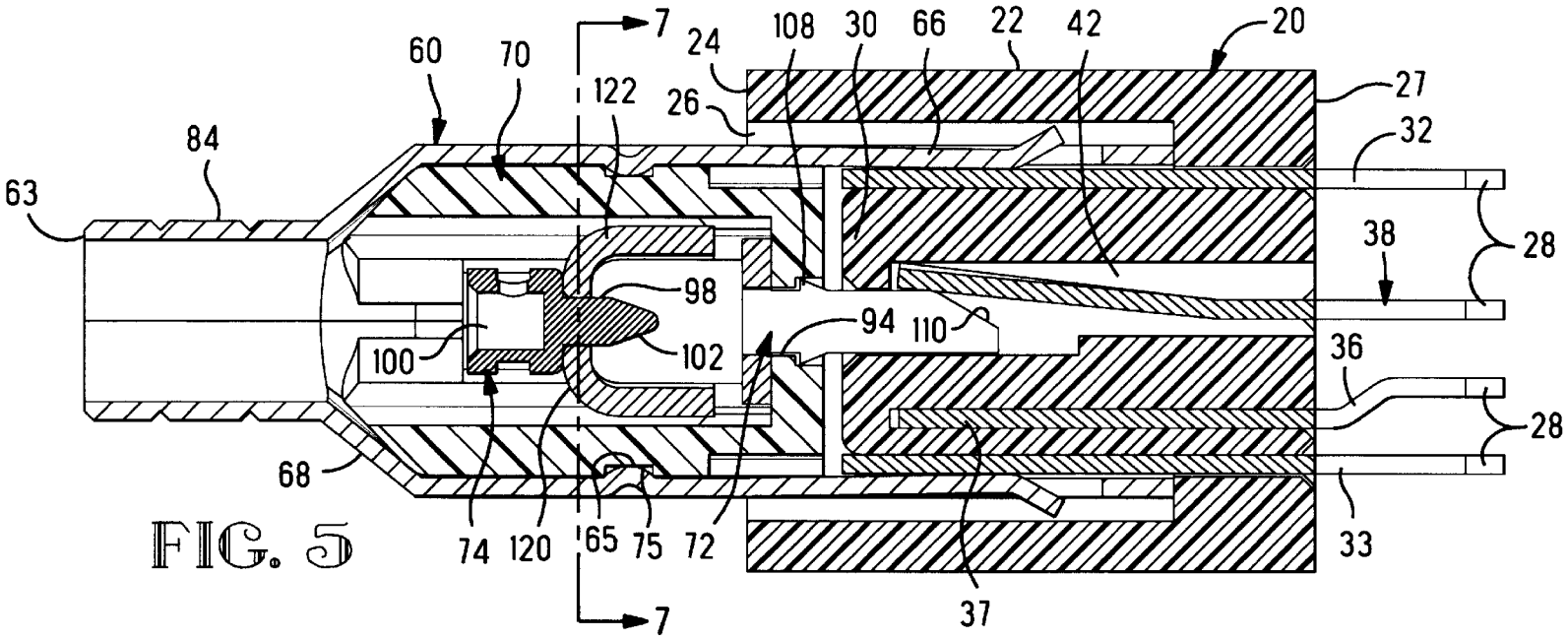
FIG. 5 shows a cross sectional view of the plug and receptacle taken along the line 5—5 of FIG. 3.

Assembly of the plug 60 will now be described in greater detail with reference to FIGS. 5 and 8. First, the center contact 72 is assembled to the dielectric 70 by inserting from the rear end until the locking lances 92 engaged the ledges 94 so that the main body 106 is positioned in the cavity and the rectangular pin 104 extends through the opening 92 into the dielectric portion receiving area 78. The pre-assembled dielectric and center contact are then inserted into the shell 68 from the mating and 64 and urged reward until reaching a final seated position as shown in FIG. 8. As the pre-assembled dielectric is being inserted into the shell 60, the shell 60 will deform slightly in the area of the dimples 65 to allow the dielectric 70 to pass. The dielectric 70 is secured in the shell 60 by engagement between the dimple 65 and the notch 75. Next, assembly of a cable to the plug 60 will be described. First, a coaxial cable is stripped in a customary way so that the center conductor extends beyond the cable dielectric and ground braid. The center conductor is inserted into the opening 100 of the ferrule 74 and then the crimp section 96 is crimped. The ferrule and cable subassembly are then inserted into the cable receiving passage. The contact section 98 is secured to the center contact 72 after the lead in section 102 passes the contact arms 120, 122. It should be noted here that the contact section engages the contact arms 120, 122 off center as best shown in FIG. 7. Since the contact arms 120, 122 do not engage the contact section 98 along its center line or diameter, they are not required to spread as far apart as they would upon contacting the diameter. Instead, the contact arms 120,122 rotate and spread to a position shown in FIG. 7. This reduces the space required in order to make an effective electrical connection and reduces the material thickness required to achieve the interface. Next, the braid (not shown) is terminated to the crimp section 84 with a ferrule (not shown) as is well known in the art to complete assembly of the plug.

Operation of the switching mechanism will now be described in greater detail with reference to FIGS. 2, 3 and 5. First, it should be noted that the receptacle 20 is shown in FIG. 2 in an unmated condition. Here, the movable contact 38 is touching the fixed contact 36 at the switch points 40, 48 and therefore the switch is closed when the plug 60 and receptacle 20 are in an unmated condition. FIGS. 3 and 5 show the plug 60 and receptacle 20 in the mated condition. Upon mating, the shell 68 of the plug 60 enters the plug receiving opening 26 of the receptacle 20. The dielectric portion 30 of the receptacle 20 enters the dielectric portion receiving area 78 of the plug 60. Also, the rectangular pin 72 enters the pin receiving opening 52 of the dielectric portion 30. The lead in surface 110 first encounters the movable contact 38 and as the plug is 60 further urged into the receptacle 20, the movable contact 30 is urged along the lead in surface 110 of the center contact 72 and away from the fixed contact 36 to the open position shown in FIG. 5. It should be noted here with reference to FIG. 3, that the pin 72 engages the cantilever beam 44 of the movable contact 36 off center. As illustrated in FIG. 3, a central axis is drawn along the section line 5—5 and it can be seen that the pin 72 is below the center line 5—5 thus causing the movable contact 38 to both translate and rotate away from the fixed contact 36. The position of the pin 104 can also be viewed as being off center with respect to a central axis extending between the mating end 64 and the cable receiving end 63 of the plug 60. It should be understood that that while this embodiment shows the pin 104 positioned below the central axis, it can be positioned on other sides of the central axis to achieve similar translational and rotational movements of the movable contact beam 44. This reduces the capacitive coupling between the fixed leg 47 and the movable contact 36 when the switch is in the open condition. Additionally, the ground contact beams 66 engage the ground contacts 32, 33 at the contact points 80 to form the electrical connection between the shell 60 and the ground contacts 32, 33 of the receptacle 20.

An advantage of this embodiment is that the center contact 72 is located off a center line 5—5 so that mating causes both rotation and translation of the movable switch contact 38 thus reducing the capacitive coupling between the fixing leg 37 and the movable contact 38. This is because these sections would otherwise act as parallel plates of a capacitor. Since the contact point 40 only accounts for a small percentage of the surface area as viewed from the movable contact 30, its spacing in the open position is not as critical. Additionally, since the separation of the movable contact 38 and fixed contact 36 is maximized at the end opposite the contact switch point 48, 40, capacitive coupling is minimized. Since the effective plates do not lie perfectly parallel to each other, this is also believed to reduce the coupling effect. Therefore, the capacitive coupling is reduced while minimizing the separation distance required in an open switch condition therefore reducing the overall size of the connector.

An additional advantage is that the interface between the receptacle movable contact 38 and plug center contact 72 is achieved in a minimum space due to the fact that the contact arms 120, 122 engage the contact section 90 off center thus reducing the amount of separation required between the arms 120, 122. This reduces the overall dimension of the plug 60.

I claim:

1. A switching contact arrangement for use in an electrical connector, the arrangement having a fixed contact, a movable contact, and a mating contact, the arrangement comprising:

the fixed contact being positioned to have a major surface substantially facing a major surface of the movable contact and a minor surface extending from the major surface and being positioned to contact a portion of the movable contact, the movable contact having a fixed end, a free end, a central axis extending along a major surface of the movable contact between a pair of edges, and a contact point for contacting the minor surface of the fixed contact, the contact point being disposed along one of the edges near the free end, the mating contact having a lead in surface profiled to fit in a space between the major surfaces of the fixed and movable contacts, the mating contact being positioned to engage the movable contact along its major surface at a point which is spaced apart from the central axis.

2. The switching contact arrangement as recited in claim 1 wherein the mating contact is positioned to contact the movable contact at a location which is on an opposite side of the central axis from the contact point.

3. The switching contact arrangement as recited in claim 1 wherein the fixed contact is substantially L-shaped in cross section to define the major surface along an inside leg of the L-shape and to define the minor surface at a tip of the other leg of the L-shape.

* * * * *